United States Patent [19]

Drumm

[11] Patent Number: 4,573,110

[45] Date of Patent: Feb. 25, 1986

[54] CONTROL DEVICE

[75] Inventor: Donald E. Drumm, Billerica, Mass.

[73] Assignee: Wang Laboratories, Inc., Lowell, Mass.

[21] Appl. No.: 655,846

[22] Filed: Sep. 28, 1984

[51] Int. Cl.[4] ..... F21V 17/02

[52] U.S. Cl. ..... 362/319; 362/320; 362/293; 362/362

[58] Field of Search ..... 362/362, 320, 319, 277, 362/293, 276, 295, 297, 301, 343, 802

[56] References Cited

U.S. PATENT DOCUMENTS 1,499,961 7/1924 Auchstetter ..... 362/320

3,089,386 5/1963 Hunt ..... 362/277

3,843,878 10/1974 Ueda et al. ..... 362/293

4,352,150 9/1982 Hosoda ..... 362/362

4,400,765 8/1983 Kochem ..... 362/319

*Primary Examiner*—Magdalen Y. C. Moy

*Attorney, Agent, or Firm*—Michael H. Shanahan; Kenneth L. Milik

[57] ABSTRACT

A reflective screen with a gradient of reflectivity is moved by a control handle outside a cabinet to display different parts of the screen through a window to a LED and a phototransistor. The changing of the light reflected by the screen from the LED to the phototransistor is used to control an electrical parameter, providing a low cost control device.

6 Claims, 6 Drawing Figures

CONTROL DEVICE

BRIEF SUMMARY OF THE INVENTION

This invention relates to apparatus by which an operator can control some parameter of electrical circuitry mounted within a cabinet from outside the cabinet.

It is frequently necessary to provide a control by which an operator can from outside an equipment cabinet adjust some parameter of electrical circuitry mounted on a printed circuit board within the cabinet. Conventionally, the control mechanism has been a potentiometer either mounted on the cabinet and connected by wires to the circuit board or mounted on the circuit board with a control handle protruding through the cabinet wall. The use of a potentiometer is expensive not only because a potentiometer is a high cost component but because considerable assembly time is required to wire in the potentiometer. Furthermore, when the potentiometer is mounted on the circuit board to obviate interconnecting plugs, the mounting errors between potentiometer and board, board to rack, rack to chassis, and chassis to cabinet are cumulative and without custom adjustment often exceed acceptable tolerances in positioning the potentiometer handle with respect to the face of the cabinet.

The invention features a control handle supported on and extending outside the cabinet and movable by an operator through a range of positions, a screen with a surface having non-uniform reflectivity attached to the handle and moving therewith, a source of light and a light sensor both mounted interior to the cabinet, the screen, the source, and the sensor being disposed so as to provide an area smaller than the screen that is illuminated by the source, in the field of view of the sensor, and occupied by a part of the surface of the screen. The part of the surface of the screen occupying the illuminated area changes as the control handle is moved through the range of positions to place regions of increasing average reflectivity in the area so that increasing amounts of light are reflected to the sensor. The light sensor has an electrical output responsive to the amount of light the sensor receives and connected to control the parameter.

The invention may additionally feature a window structure supported on the cabinet and defining a window exposing a part of the screen surface to view from the interior of the cabinet, the part of the screen surface exposed to view through the window changing to expose regions of the screen surface with changing average reflectivity as the control handle is moved through the range of positions; low reflectivity in an area surrounding the window; a screen made of a strip of flexible material; and confining the strip in a channel with two legs joined by a curved transition section, one of the legs mounted parallel to the cabinet in the area of the handle and the other of the legs providing the window structure.

DETAILED DESCRIPTION

Figure 1:
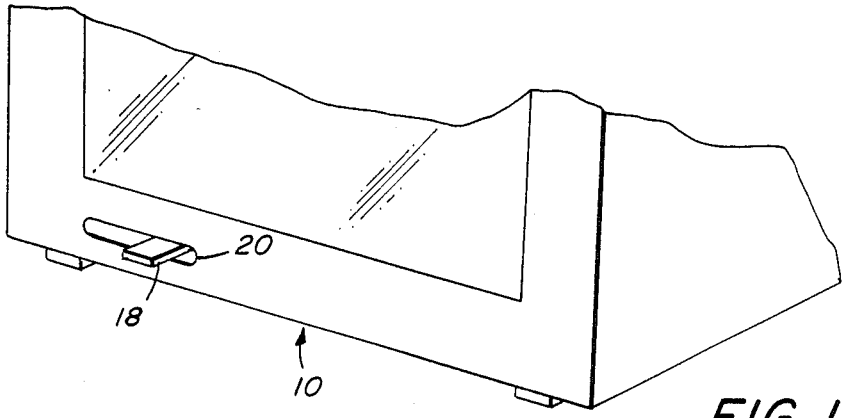
FIG. 1 shows a cabinet on which apparatus according to the invention is installed.
Figure 2:
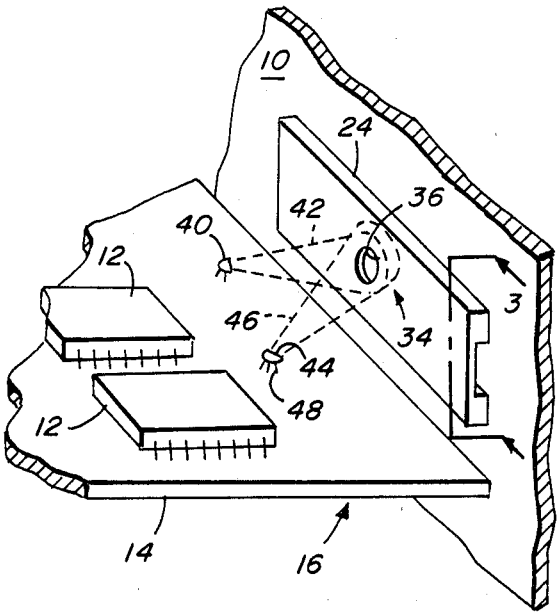
FIG. 2 shows the apparatus of FIG. 1 as seen from the rear of the cabinet wall.
Figure 3:
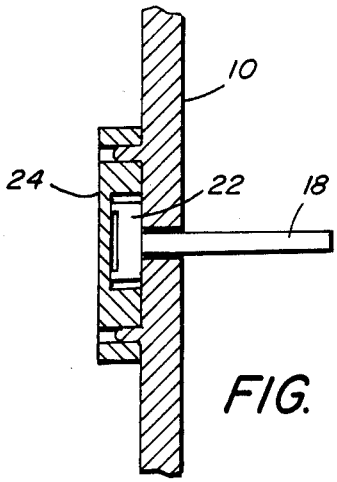
FIG. 3 shows a cross section of the apparatus shown in FIG. 2 along section 3—3.
Figure 4:
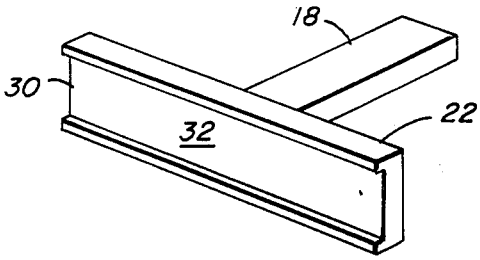
FIG. 4 shows certain components of the apparatus of FIG. 2.

Referring to the figures, cabinet 10 encloses printed circuit board 14, on which is mounted electrical circuitry 12 which has some parameter, such as display brightness, which is to be controlled by an operator from outside the cabinet. Control apparatus 16 according to the invention for doing this includes control handle 18 which is supported on cabinet 10 and extends out therefrom. Handle 18 is movable by an operator through a range of positions in slot 20 in cabinet 10. Screen support 22 is attached to handle 18 and is captured beneath retainer plate 24 against the wall of cabinet 10, as particularly shown in FIG. 3. Screen 30, mounted on screen support 22, has a diffusely reflective surface 32 with the average reflectivity progressively increasing from one end to another. The varation in reflectivity may be conveniently effected by placing back dots on an initially white screen, the dots being more densely distributed towards one end of the screen than the other. A portion of retainer plate 24 provides window structure 34 defining window 36 which exposes a part of screen surface 32 to view from the interior of cabinet 10. The area surrounding window 36 may advantageously be given a low reflectivity.

Light source 40 is mounted on circuit board 14 so as to direct its beam of light 42 at window 36, and light sensor 44 is mounted on board 14 so as to have its field of view 46 include window 36. Source 40 and sensor 44 may advantageously be paired electro-optical devices such as an IR LED and phototransistor. Such devices may be cheaply installed on circuit board 14 and the electrical leads 48 of sensor 44 and other connections connected to circuitry 12 by wave soldering.

In operation, an operator, wishing to adjust display brightness, moves handle 18. This in turn moves screen 32 so that a different part of the screen is exposed through window 36. The reflectivity of the part of the screen newly exposed through the window will be different than that of the part previously exposed, because of the variation in reflectivity along the screen surface. The amount of light originating from source 40 that is reflected back to sensor 44 will accordingly change. The change in light received by sensor 44 causes a change in the electrical output signal, which controls the display brightness.

Figure 5:
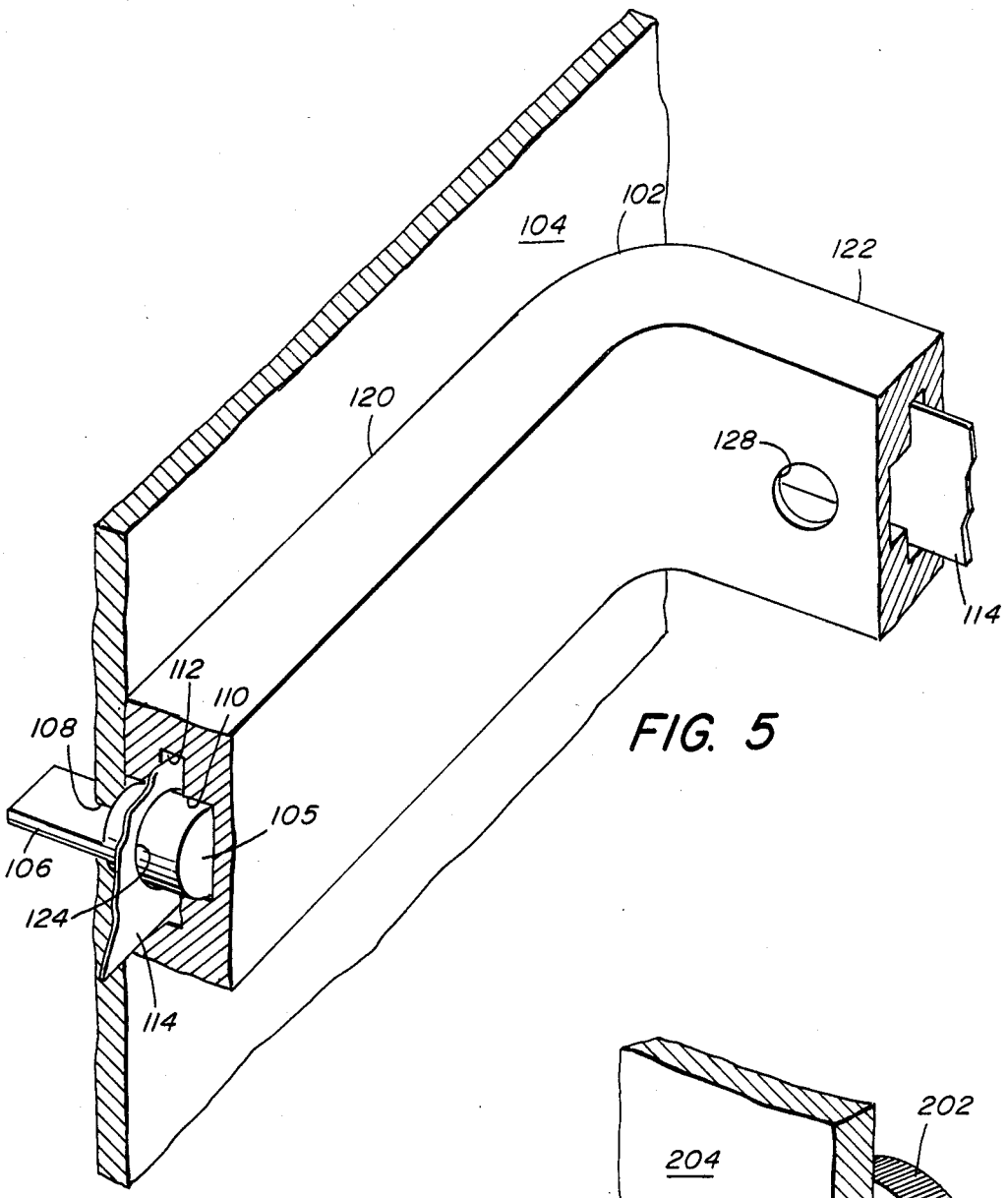
FIG. 5 shows a second embodiment of the invention.
Figure 6:
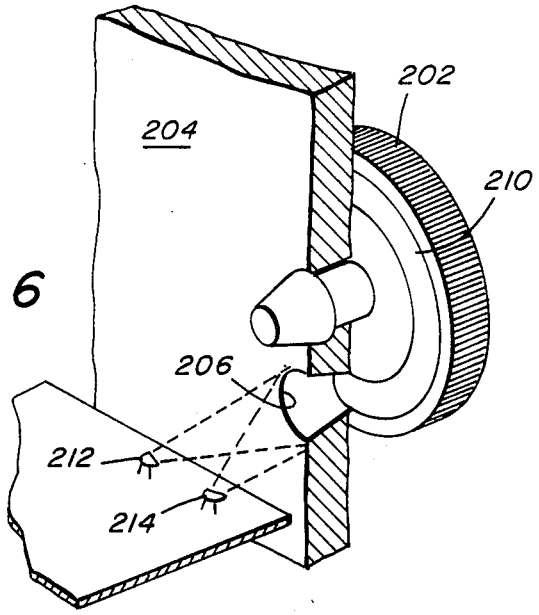
FIG. 6 shows a third embodiment of the invention.

In an alternative embodiment shown particularly in FIG. 5, retainer 102 is attached to the interior of cabinet 104, capturing slider 105 beneath it. Control handle 106 extends outward through slot 108 in cabinet 104 to be accessible to an operator. Retainer 102 is bent to form two legs joined by a curved transition section 107, of which the first leg 120 is parallel to and attached to cabinet 104, and the second 122 extends inwards from the cabinet wall. Retainer 102 has a first channel 110 retaining slider 105, and a deeper channel 112 in which screen 114, made of a strip of flexible material, is confined. Screen 114 is pierced by hole 124, through which slider 105 passes so that screen 114 is constrained to move along channel 112 as slider 105 moves. A window 128 is provided in leg 122 where a part of screen 114 is exposed to view. A light source and sensor are mounted in position to view window 128 and to control an electrical parameter in a manner analogously to that previusly described, and the surface of screen 114 is similarly given reflectivity with a gradient. An advantage of he apparatus shown in FIG. 5 is that the light source nd sensor can be positioned away from the cabinet vall where the control handle is situated, when that is ecessary or convenient.

In a third embodiment of the invention shown in IG. 6, control knob 202 is snapped into cabinet 204. Vindow 206 pierced in the wall of cabinet 204 exposes part of the surface of annular shaped screen 210 attached to knob 202. The surface of screen 210 has a eflectivity with a gradient as described previously. ight source 212 illuminates and sensor 214 views window 206. They are connected as previously described to ontrol an electrical parameter as knob 202 is rotated.

I do not limit my claims to the details shown in the everal embodiments described above, which are to be onsidered as examples only of the wide range of adaptations of my invention which will occur to those killed in the art.

I claim:

1. Apparatus for inputting a control signal from an perator situated outside of a cabinet to control some arameter of electrical circuitry mounted interior to aid cabinet, comprising a control handle supported on and extending outside said cabinet and movable by an operator through a range of positions, a screen with a surface having non-uniform reflectivity, said screen being attached to said handle and moving therewith, a window structure supported on said cabinet and defining a window exposing a part of said screen surface to view from the interior of said cabinet, the part of the screen surface exposed to view through said window changing to expose regions of said screen surface with changing average reflectivity as said control handle is moved through said range of positions, a source of light mounted interior to said cabinet so as to direct light through said window to illuminate the part of said screen surface in view, a light sensor mounted interior to said cabinet so as to have its field in view include said window, said light sensor having an electrical output signal responsive to the amount of light the sensor receives and connected to control said parameter.

2. Apparatus as claimed in claim 1, wherein said window structure has low reflectivity in an area surrounding said window.

3. Apparatus as claimed in claim 1, wherein said light source and said sensor are electro-optical devices mounted on a printed circuit board.

4. Apparatus as claimed in claim 1, wherein said screen is a strip of flexible material.

5. Apparatus as claimed in claim 4, wherein said strip is confined in a channel with two legs joined by a curved transition section, one of said legs mounted parallel to the cabinet in the area of said handle and the other of said legs providing said window structure.

6. Apparatus for inputting a control signal from an operator situated outside of a cabinet to control some parameter of electrical circuitry mounted interior to said cabinet, comprising a control handle supported on and extending outside said cabinet and movable by an operator through a range of positions, a screen with a surface having non-uniform reflectivity, said screen being attached to said handle and moving therewith, a source of light mounted interior to said cabinet, a light sensor mounted interior to said cabinet, said screen, said source, and said sensor being disposed so as to provide an area smaller than said screen that is illuminated by the source, in the field of view of the sensor, and occupied by a part of the surface of the screen, said screen moving to position parts of the surface of the screen with increasing average reflectivity in said area as said control handle is moved through said range of positions, said light sensor having an electrical output signal responsive to the amount of light the sensor receives and connected to control said parameter.

* * * * *